United States Patent [19]

Howerton

[11] 4,365,718

[45] Dec. 28, 1982

[54] TICKET METERING AND THROAT BARRIER MODULE

[75] Inventor: Darrell V. Howerton, San Diego, Calif.

[73] Assignee: Cubic Western Data, San Diego, Calif.

[21] Appl. No.: 211,030

[22] Filed: Dec. 1, 1980

[51] Int. Cl.[3] ..... B07C 5/04

[52] U.S. Cl. ..... 209/586; 209/534; 250/223 R; 250/571; 235/480; 235/92 SB; 194/102; 194/4 C

[58] Field of Search ..... 209/552, 534, 586; 194/102, 4 C, 4 B, 4 D, 4 G, DIG. 8, DIG. 9, 4 E, 4 F; 232/8, 18; 235/476, 480, 92 SB; 250/223 R, 571

[56] References Cited

U.S. PATENT DOCUMENTS

| | | | |
|---|---|---|---|
| 3,064,785 | 11/1962 | Weingart | 194/4 F |
| 3,384,234 | 5/1968 | Elmore | 209/534 |
| 3,731,799 | 5/1973 | Meloni et al. | 194/4 E X |
| 3,815,719 | 6/1974 | Streeter et al. | 194/102 X |
| 3,850,299 | 11/1974 | Kreitzer | 209/534 X |
| 3,924,847 | 12/1975 | Pescetto | 209/534 X |

*Primary Examiner*—Allen N. Knowles
*Attorney, Agent, or Firm*—Brown & Martin

[57] ABSTRACT

A ticket metering and barrier module for a ticket processing machine includes a housing defining a metering passage that is dimensioned to a predetermined maximum ticket thickness and includes sensing apparatus for sensing predetermined minimum ticket width and length and a barrier gate selectively movable into and out of blocked positions for blocking the insertion of tickets into the passage.

6 Claims, 6 Drawing Figures

TICKET METERING AND THROAT BARRIER MODULE

REFERENCE TO RELATED APPLICATIONS

The present application is directed to a modular unit that is part of a system covered by co-pending application entitled "Modularized Ticket Handling System For Use In Automatic Ticket Processing System", by John B. Roes, et al. and filed concurrently herewith.

BACKGROUND OF THE INVENTION

The present invention relates to ticket handling and processing systems and pertains particularly to a metering module for ticket processing systems.

Tickets are used extensively throughout the world today for controlling the admission of patrons to entertainment and sporting events, and on transportation systems. Automated ticket handling systems are coming into widespread use throughout many areas of the world today for these purposes. Such systems are useful in conjunction with such patron control because it tends to reduce labor costs involved in ticket handling and also reduces losses to theft and pilferage.

In order to be feasible, such automated systems must be highly reliable and durable and easily repaired. While machines are designed to handle tickets with a wide margin of tolerances, it is desirable that only authentic tickets be inserted into the processing system in order to avoid jamming, blockage and/or damage to the systems. Uniformity of ticket size aids in the authentication of a ticket. Machines and systems can be designed to accept only tickets within a certain tolerance range and with coding accurately located within the ticket body.

It is therefore desirable that such system have means for preventing the insertion of non-standard tickets and the like into such systems. It is also desirable for such system to have means for preventing insertion of more than one ticket at a time to permit the sequential processing of tickets without jamming and the like.

SUMMARY AND OBJECTS OF THE INVENTION

It is therefore the primary object of the present invention to provide an improved metering and barrier module for a ticket handling system.

In accordance with the primary aspect of the present invention a ticket metering unit for a ticket system includes a ticket receiving slot with means defining a metering slot of a predetermined thickness and width for establishing the maximum thickness and width of a ticket and sensing means within the metering throat to establish the minimum width of a ticket and a gate member for selectively blocking the metering throat to prevent the insertion of a ticket therein when a prior ticket is being processed or the system is shut down.

BRIEF DESCRIPTION OF THE DRAWINGS

The above and other objects and advantages of the present invention will become apparent from the following description when read in conjunction with the drawings wherein.

DETAILED DESCRIPTION OF A PREFERRED EMBODIMENT

Figure 1:
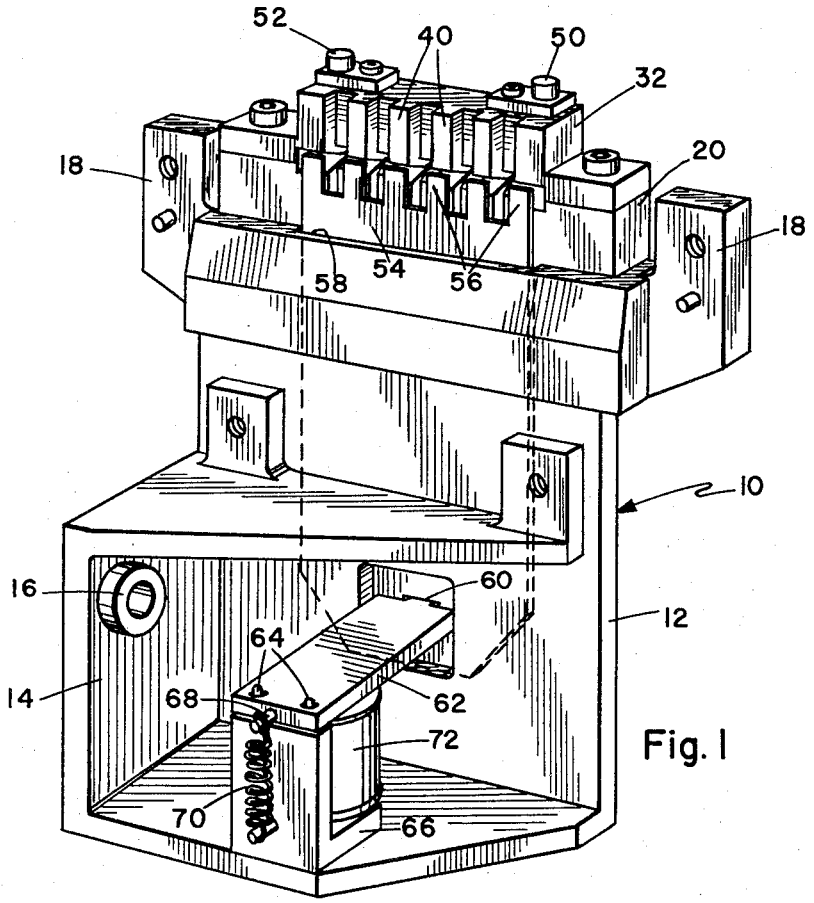
FIG. 1 is a perspective view of the throat and barrier from the entry side.
Figure 2:
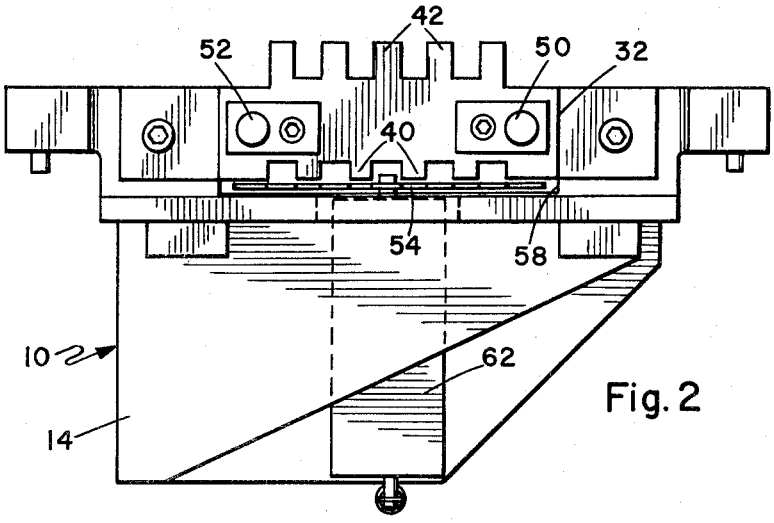
FIG. 2 is a top plan view of the throat and barrier.

Turning to FIG. 1 of the drawings a metering module designated generally by the numeral 10 is illustrated in accordance with the invention. The unit comprises a base mounting plate for support member 12 having a bracket 14 for detachably mounting to a wall member of a ticket processing system. The unit is designated to fit at the inlet end of a ticket handling and processing system for receiving tickets of a predetermined size. The unit includes at least one bolt receiving bore 16 for attachment to a wall panel for quick mounting and detachment of the unit. With this construction, the unit can be quickly and easily removed and replaced in a system. Also, a pair of brackets 18 are adapted to secure a bezel for patron interface with the unit.

Figure 3:
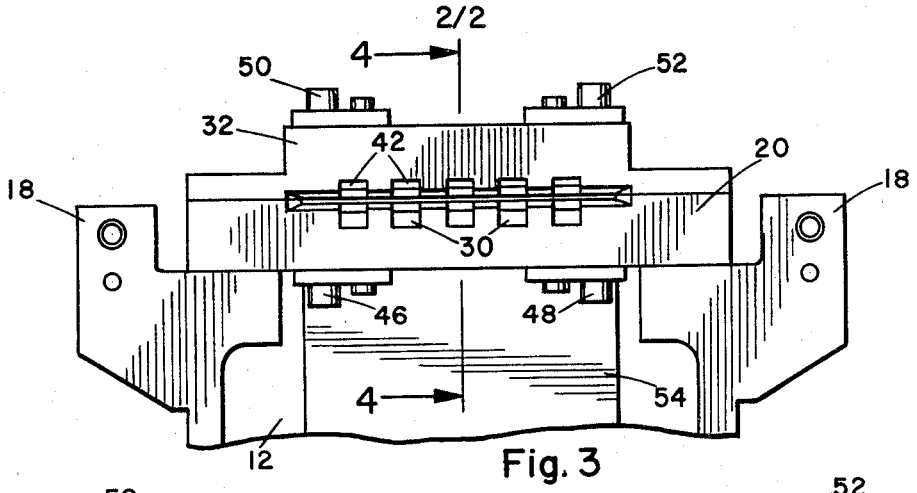
FIG. 3 is an elevation view of the exit side of the throat barrier.
Figure 4:
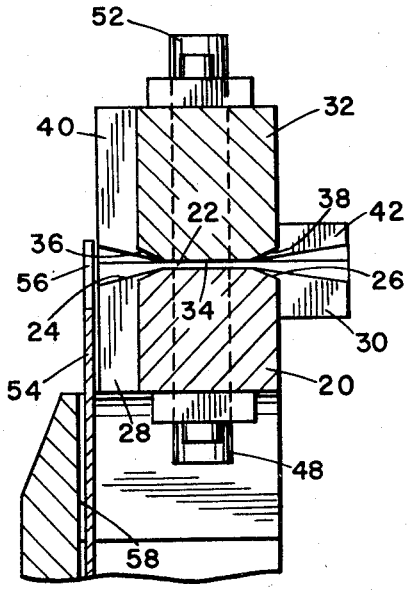
FIG. 4 is an enlarged sectional view taken on line 4—4 of FIG. 3.
Figure 5:
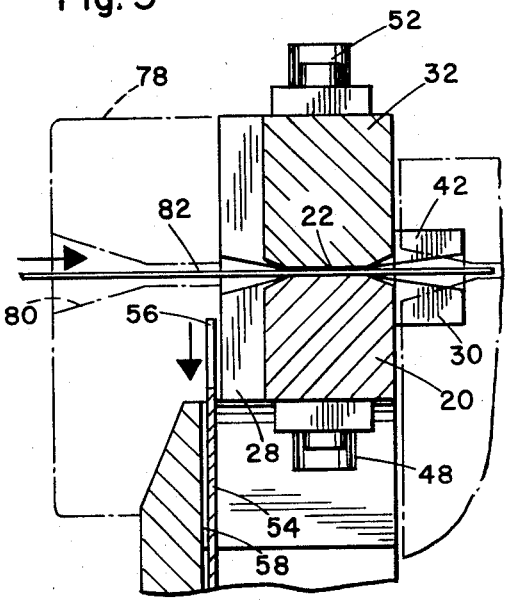
FIG. 5 is a similar sectional view showing the entry of a ticket.

The ticket metering throat of the unit includes a base member 20 as best seen in FIGS. 3–5, with a slot 22 having a predetermined width and depth which defines the passage or throat. The slot is formed with a beveled inlet and outlet as best seen in FIGS. 4 and 5, defined by a sloping face 24 on the inlet side of the throat and 26 on the outlet side. Fingers 28 and 30 project forward and backward respectively for interfacing with adjacent units in the system. The slope and fingers provide and/or permit interfacing of adjacent units with passageways such that minor misalignments of the passageways do not interfere with the passage of a ticket from one unit to the next.

The throat 22 is completed by an upper plate or member 32 which is detachably mounted on top of the lower plate 20 and includes a lower surface 34 cooperating with the slot 22 to complete and define the metered throat of a predetermined thickness. The upper plate similarly includes a forwardly sloping surface 36 at the forward edge of the lower surface 34 and a sloping or beveled surface 38 at the trailing or outlet end thereof. These sloping surfaces, as can be best seen in FIGS. 4 and 5, permit the easy passage of the forward edge of a ticket into the throat of the unit. The upper member 32 similarly includes forwardly extending fingers 40 and aft extending fingers 42 for interfacing with an adjacent related portion or unit of the system.

As best seen in FIG. 3, electronic sensing devices such as light beams or the like received by sensing elements 46 and 48 on the lower plate 20 and light generating elements such as light emitting diodes (LED's) 50 and 52 on the upper plate 32 cooperate to sense the passage of a ticket through the throat of a passageway. These sensing elements as will be described, cooperate with control means in the system for sensing the width and length of tickets passing through the unit and can function to control the subsequent unit such as a transport unit for rejecting a ticket or the like. The maximum permissible width of a ticket is predetermined by the width of the throat. The maximum thickness is of course defined by the thickness of the throat. These determine the maximum dimensional parameters insofar as width and thickness of the ticket to pass into the system. The remaining units in the system are preferably dimensioned to receive larger sized tickets but such larger tickets are prevented from entering the system by the metering throat and unit. The ticket size can obviously be changed by changing the members 32 and 20 which make up the metering throat.

The minimum width of the ticket and the length can be determined by sensing means such as the units 46, 48, 50 and 52, in conjunction with further sensing units and control means from the adjacent transport unit. The sensing means for example and control system can be programmed to permit the passage of tickets which are sufficient in width to interrupt the beams between the respective sensing units 46, 50, and 48, 52, upon passage therebetween.

Figure 6:
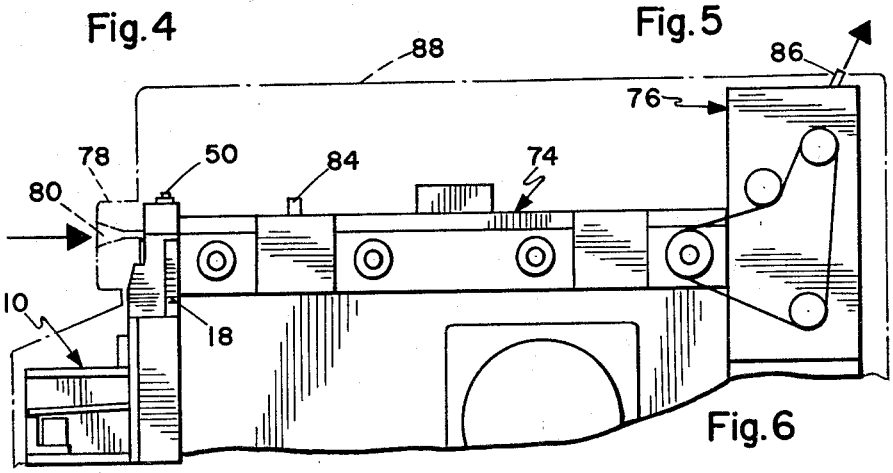
FIG. 6 is a side elevation view of a ticket processing system incorporating the throat barrier.

Turning back to FIG. 1, there is illustrated a barrier member, or gate unit 54 which comprises an elongated generally rectangular plate having a plurality of barrier teeth 56 at the upper end for extending between the fingers of the lower member or the fingers extending to the lower member from an adjacent interfacing unit. This plate is reciprocably mounted within a generally rectangular slot or passageway 58 formed in the base support member 12. The lower end of the plate or member 54 includes a slot 60 receiving the end of a lever 62 which is pivoted on pins 64 of a pedestal 66 on the base member. The outer end of the lever 62 includes a pin or the like 68 which is engaged by a coiled tension spring 70 for biasing the lever into a position for lifting the plate 54 to the uppermost position, for blocking the entry to the ticket metering throat as can be seen for example, in FIG. 4. A solenoid 72 is mounted beneath the lever 62 which also functions as an armature and can be drawn downward by the activation of the solenoid 72 for pulling the teeth or barrier portions 56 of the plate 54 into a non-blocking position as shown in FIG. 6, to permit the entry and passage of a ticket through the throat of a unit. In this preferred form, the gate or barrier member is pre-biased by spring means 70 to the blocking position as shown in FIG. 4. Upon activation of the machine, the solenoid 72 is activated and withdraws the gate or member 54 from it's blocking position, as shown in FIG. 5.

Turning to FIGS. 5 and 6 it will be seen that the unit of the present invention is adapted to fit adjacent to and interface with a transport unit 74 for metering the passage of tickets to the transport unit. This transport unit is similarly a modular unit and comprises one unit of a gated system such as that illustrated in FIG. 6, which may also include a diverter unit for diverting accepted tickets to one or more collection or return points. In the illustrated embodiment a bezel or ticket receiving unit 78 is detachably secured to the face or front end of the ticket metering unit and includes a tapered ticket receiving slot 80 matched to the inlet end of the throat of the metering unit for receiving and passing a ticket 82 therethrough. The ticket passes from the throat of the metering unit into an inlet passageway of the transport unit 74.

The transport unit 74 is reversible and performs many of the functions of processing of the ticket such as reading and the like. This unit includes a sensing element 84 which functions in conjunction with the sensing units 46, 50 and 48, 52 for establishing or sensing the length of a ticket that has passed through the throat of a metering unit. Should the ticket not correspond to a predetermined width or length, the transport unit would be signaled to reverse and the ticket will be ejected back out the inlet slot 80.

Should the ticket be acceptable in size, the ticket is then passed through and processed by the system and/or assuming a passage or gate and the ticket determined to be a bonafide ticket, will activate the patron gate permitting the patron to pass through and receive the returned ticket at 86 from the exit unit 76. The entire system can be housed or contained within a cover 88 such that only the inlet end 80 and the outlet at 86 are accessible from the exterior of the unit by a patron or the like.

While the present invention has been illustrated and described by means of specific embodiments, it is to be understood that numerous changes and modifications may be made therein without departing from the spirit and scope of the invention as defined in the appended claims. For example, the ticket metering unit can be utilized in conjunction with other forms of tickets processing systems than that described.

I claim:

1. A ticket metering module for detachably mounting in interfacing relation to an adjacent ticket processing machine for controlling the receipt of tickets into a ticket processing machine, said module comprising:

a base support frame;

housing means including first and second plate members mounted on said support frame and cooperatively positioned for defining a ticket metering passage having an inlet and outlet and a generally rectangular cross-sectional configuration of a predetermined dimension;

said housing including finger means projecting outwardly at said inlet and said outlet for cooperative interfacing of said passage with a like ticket passage of adjacent ticket processing modules; and a barrier member reciprocably mounted adjacent the inlet of said passage and selectively movable transverse of said passage and into blocking and nonblocking positions across said inlet for selectively blocking the passage of a ticket into said passage.

2. The ticket metering unit of claim 1 wherein:

the width of said passage determines the maximum width of a ticket; and sensing means disposed in said housing for sensing the minimum permissible width of a ticket in said passageway.

3. The ticket metering unit of claim 2 wherein said inlet and said outlet of said passage are V-shaped in cross-section.

4. The ticket metering unit of claim 3 including:

first biasing means for normally biasing said barrier member into said blocking position; and second biasing means for selectively biasing said barrier member out of blocking position.

5. The ticket metering unit of claim 4 wherein said barrier member comprises a flat generally rectangular plate reciprocably mounted on said support frame; and one end of said plate disposed adjacent said inlet and including a plurality of fingers movable into said blocking position and said nonblocking position.

6. The ticket metering unit of claim 5 wherein said first biasing means comprises a spring for biasing said plate into blocking position; and said second biasing means comprises a solenoid for biasing said plate to the nonblocking position.

* * * * *